US007387525B1

(12) United States Patent
Huang

(10) Patent No.: US 7,387,525 B1
(45) Date of Patent: Jun. 17, 2008

(54) PLUG CONNECTOR

(75) Inventor: Kun-Li Huang, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/871,799

(22) Filed: Oct. 12, 2007

(51) Int. Cl.
*H01R 13/627* (2006.01)

(52) U.S. Cl. ..... 439/352

(58) Field of Classification Search ..... 439/350–358
See application file for complete search history.

(56) References Cited

U.S. PATENT DOCUMENTS 4,313,246 A * 2/1982 Fohl ..... 24/635
4,441,776 A * 4/1984 Anhalt ..... 439/347
6,033,250 A * 3/2000 Pauza ..... 439/357
6,231,385 B1 * 5/2001 Kuo ..... 439/557
6,257,915 B1 * 7/2001 Endo ..... 439/357
6,257,916 B1 * 7/2001 Kuo ..... 439/358
6,257,925 B1 * 7/2001 Jones ..... 439/557
2005/0254246 A1 * 11/2005 Huang ..... 362/362
2008/0055417 A1 * 3/2008 Chou et al. ..... 348/207.99

* cited by examiner

*Primary Examiner*—James Harvey
(74) *Attorney, Agent, or Firm*—WPAT, P.C.; Anthony King

(57) ABSTRACT

A plug connector includes a housing, a plurality of electric terminals, at least one latch mechanism and a cover. The housing defines a plurality of terminal chambers for receiving the electric terminals. Two sides of the housing respectively define a perforation. The latch mechanism has two beams. Two ends of the beam protrude outward to form a preventing section and a termination section. An inside of the beam defines a plurality of projections and recesses buckling with each other. Rear ends of the beams extend rearward and bend inward to connect with each other to form a latch tab. The preventing section and the termination section abut against the outside of the perforation. Both ends of the cover respectively define a block lying between the two termination sections to prevent the two termination sections from jointing together to ensure the latch mechanism is held in the housing firmly.

3 Claims, 4 Drawing Sheets

PLUG CONNECTOR

BACKGROUND OF THE INVENTION

1. Field of the Invention

The present invention generally relates to a plug connector, and more particularly to a latch mechanism of a plug connector.

2. The Related Art

Plug connectors are extensively used in the field of the electronics industry. Traditionally, a plug connector includes a housing, a plurality of electric terminals and a cover. The housing has a plurality of terminal chambers. The cover mating with the housing defines a plurality of apertures. The electric terminal received in the terminal chamber of the housing has a contact portion and a soldering portion. The contact portion and the soldering portion stretch out from the terminal chamber. The contact portion connects with an electric terminal of a socket connector and the soldering portion passes through the aperture of the cover to connect with a conductive cable by way of the high-temperature shaping.

The plug connector further includes a latch mechanism to ensure that the electric terminal thereof connects with the electric terminal of the socket connector firmly. The latch mechanism has a latch tab and two beams. Two sides of the terminal chamber of the housing respectively define a perforation to receive the latch mechanism. Accordingly two sides of the socket connector respectively define a locking hole for receiving the latch tab of the latch mechanism of the plug connector to ensure the electric terminals of the plug and socket connector connecting with each other firmly.

However, when the latch mechanism is configured in the perforation of the housing, free ends of the two beams of the latch mechanism are apt to joint together because of being softened in the process of high-temperature shaping, so that the latch mechanism comes off the housing.

SUMMARY OF THE INVENTION

An object of the present invention is to provide a plug connector including a housing, a plurality of electric terminals received in the housing, at least one latch mechanism and a cover mating with the housing. The middle of the housing defines a plurality of terminal chambers, two sides of the housing form two sidewalls and each sidewall defines a perforation passing through a front surface and a rear surface thereof. A top and bottom of the rear of the perforation respectively concave outward to form a pair of grooves, a preventing surface is formed at the junction of the perforation and the groove. The electric terminal is received in the terminal chamber of the housing. The latch mechanism has a pair of beams extending longitudinally and spacing from each other. A rear end of the beam protrudes outward to form a preventing section and a front end of the beam protrudes outward to form a termination section. An inside of one of the beams defines a first projection and two first recesses adjacent to two sides of the first projection. Accordingly, an inside of the other beam defines a second recess and two second projections adjacent to two sides of the second recess. The rear ends of the two beams respectively extend rearward and then bend inward to connect with each other to form a latch tab. The preventing section is received in the corresponding groove and against the preventing surface. The termination section abuts against the front surface of the sidewall. The projections and the corresponding recesses buckle with each other. The cover covers a front surface of the housing and has a base. Both ends of the base respectively extend sideward to form a clasping portion. An upper place and a lower place of a rear surface of each clasping portion respectively concave inward to form a hollow to receive the corresponding termination section of the latch mechanism. A block is formed between the two hollows and lies between the two termination sections of the latch mechanism.

As described above, when the latch mechanism is configured in the housing, the preventing section and the termination section can firmly abut against the preventing surface and the front surface of the sidewall of the housing. At the same time, the block of the cover can prevent the two termination sections of the latch mechanism from jointing together because of being softened in the process of high-temperature shaping to ensure that the latch mechanism is held in the housing firmly.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
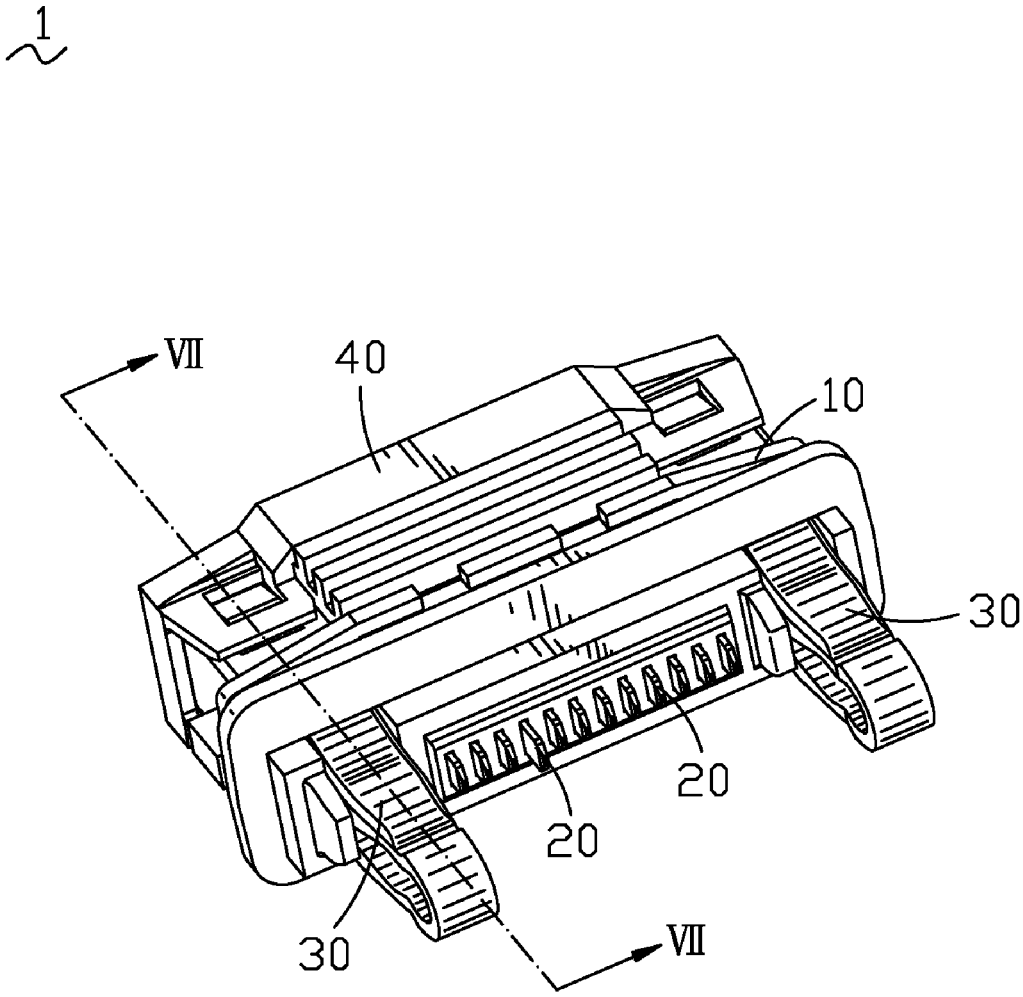
FIG. 1 is a perspective view of a plug connector in accordance with the present invention.

With reference to FIG. 1, a plug connector 1 includes a housing 10, a plurality of electric terminals 20 received in the housing 10, two latch mechanisms 30 and a cover 40 mating with the housing 10.

Figure 2:
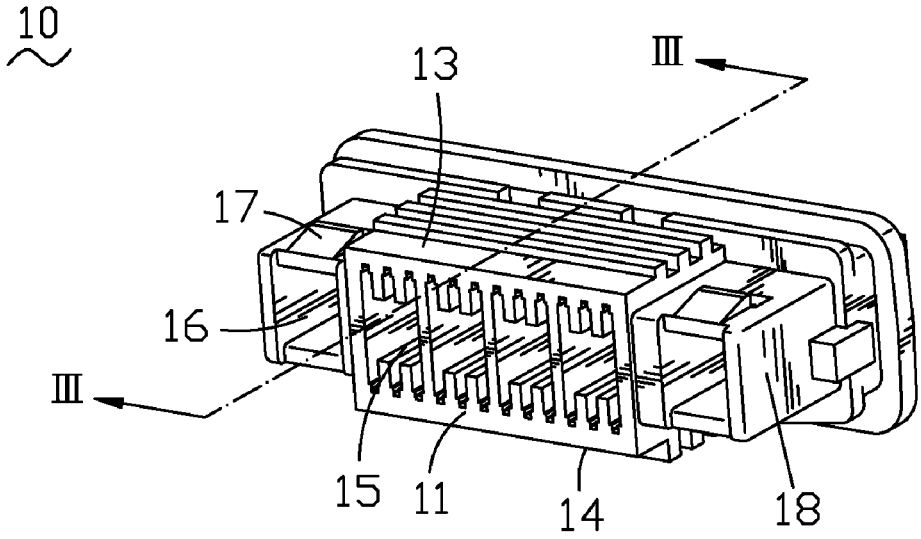
FIG. 2 is a perspective view of a housing of the plug connector.
Figure 3:
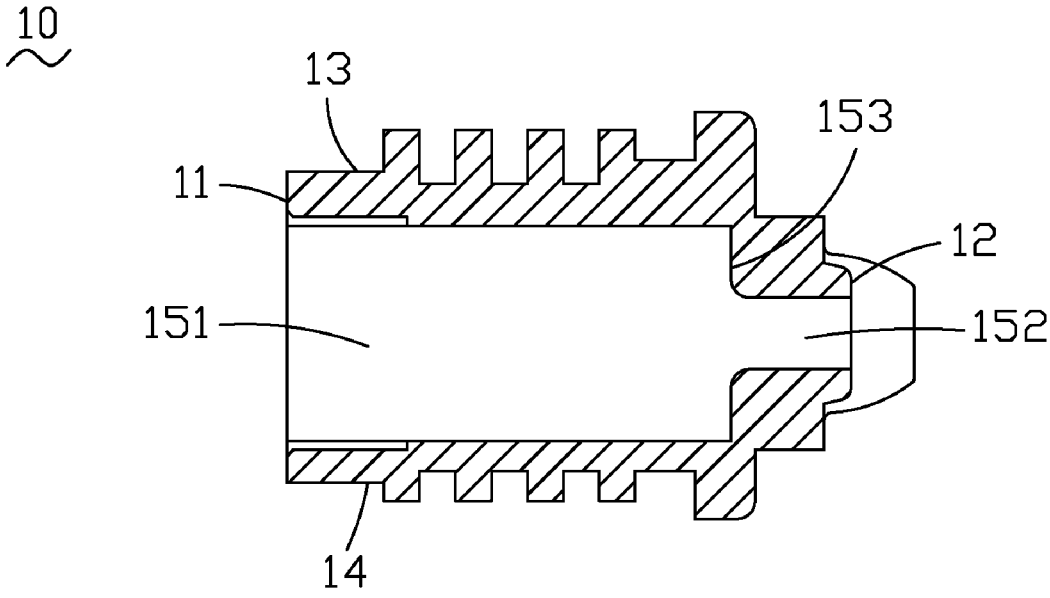
FIG. 3 is a cross-sectional view of the housing of the plug connector along line III-III of FIG. 2.
Figure 7:
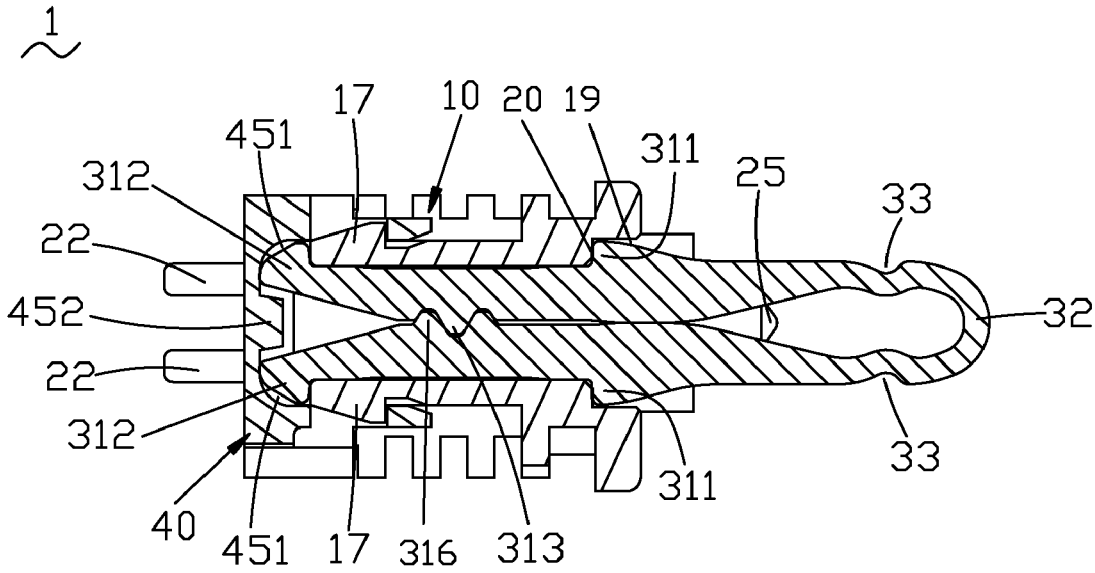
FIG. 7 is a cross-sectional view of the plug connector along line VII-VII of FIG. 1.

Referring to FIG. 2, FIG. 3 and FIG. 7, the housing 10 is of rectangular shape and has a front surface 11, a back surface 12, a top surface 13 and a bottom surface 14. The middle of the housing 10 defines a plurality of terminal chambers 15 passing through the front surface 11 and the back surface 12 in a longitudinal direction. The front of each terminal chamber 15 defines a plurality of terminal cavities 151 and the back of each terminal chamber 15 defines a plurality of terminal slots 152 at regular intervals along the longwise direction thereof, the terminal slot 152 is corresponding to the terminal cavity 151 and connects the middle of the terminal cavity 151. Accordingly, a preventing wall 153 is formed at the junction of the terminal cavity 151 and the terminal slot 152. Two sides of the housing 10 form two sidewalls 18 and each sidewall 18 defines a rectangular perforation 16 passing through a front surface and a rear surface thereof. A top and bottom of the rear of the perforation 16 respectively concave outward to form a pair of grooves 19, accordingly, a preventing surface 20 is formed at the junction of the perforation 16 and the groove 19. The front of top and bottom surfaces of the sidewall 18 respectively defines a fixing lump 17.

Figure 4:
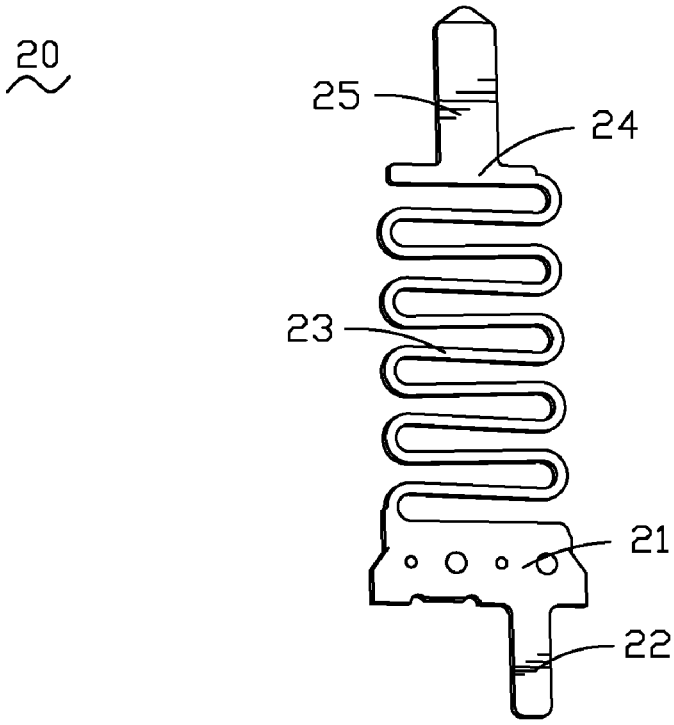
FIG. 4 is a perspective view of terminals of the plug connector.

Referring to FIG. 4, each electric terminal 20 has a fixing portion 21. One side of the fixing portion 21 extends forward to form a soldering portion 22 and the other side of the fixing portion 21 bends rearward repeatedly to form a bent portion 23. A free end of the bent portion 23 defines a preventing portion 24 paralleling the fixing portion 21. A contact portion 25 extends rearward from the outside of the preventing portion 24.

Figure 5:
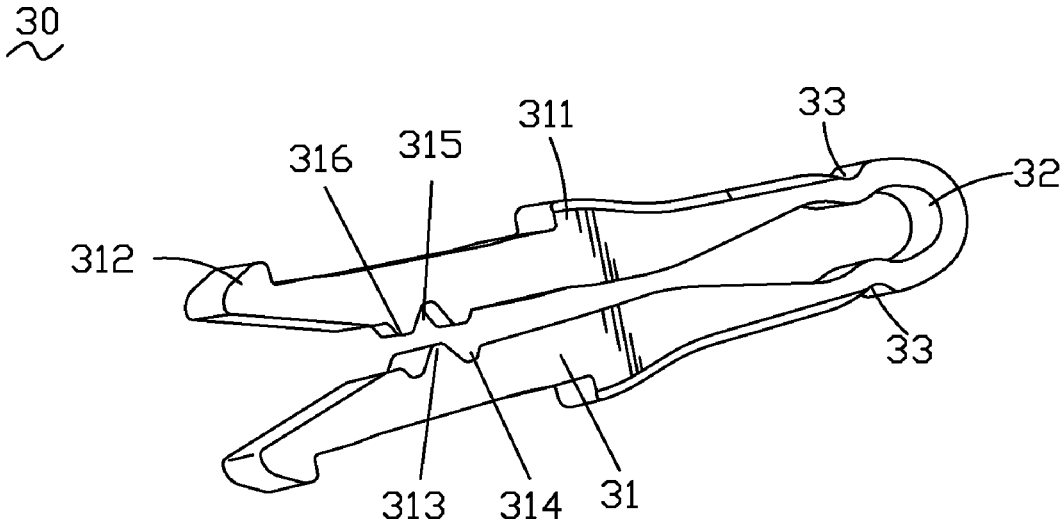
FIG. 5 is a perspective view of a latch mechanism of the plug connector.

Referring to FIG. 5, each latch mechanism 30 has a pair of beams 31 extending longitudinally and spacing from each other. The inside of two ends of each beam 31 slightly leans outward. A rear end of the beam 31 protrudes outward to form a preventing section 311 and a front end of the beam 31 protrudes outward to form a termination section 312. An appropriate place of the inside of one of the beams 31 defines a first projection 313 and two first recesses 314 adjacent to two sides of the first projection 313, an appropriate place of the inside of the other beam 31 defines a second recess 315 and two second projections 316 adjacent to two sides of the second recess 315. The rear ends of the two beams 31 respectively extend rearward and then bend inward to connect with each other to form a latch tab 32. A top and bottom of the latch tab 32 respectively concave inward to form a fillister 33.

Figure 6:
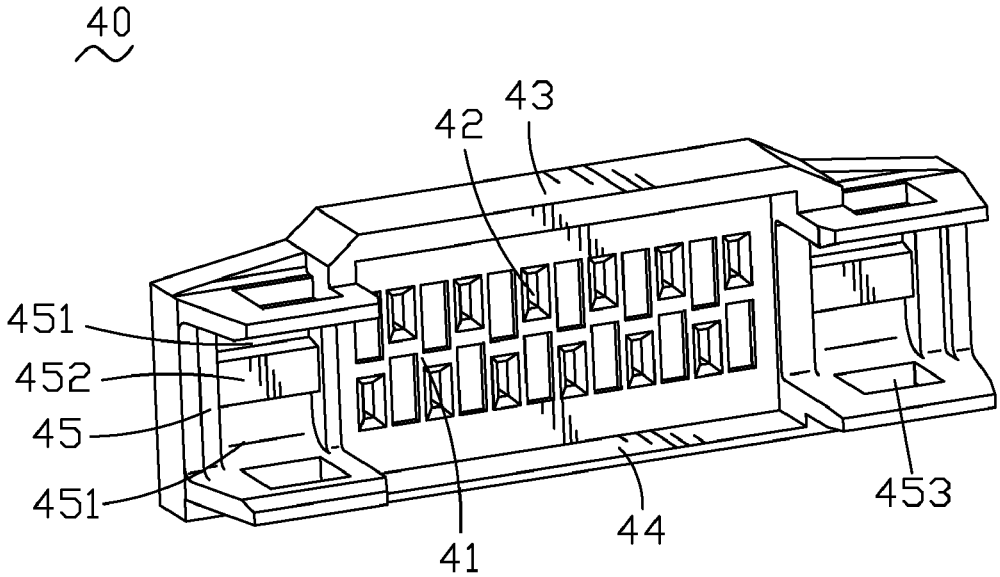
FIG. 6 is a perspective view of a cover of the plug connector.

Referring to FIG. 6, the cover 40 mating with the housing 10 has a base 41. The base 41 defines a plurality of apertures 42 communicating with the terminal cavities 151 of the housing 10 for receiving the soldering portions 22 of the electric terminals 20. A top and bottom of the base 41 respectively extend rearward to form a top wall 43 and a bottom wall 44. Both ends of the base 41 respectively extend sideward to form a clasping portion 45 in accordance with the perforation 16 of the housing 10. An upper place and a lower place of a rear surface of each clasping portion 45 respectively concave inward to form a hollow 451 to receive the corresponding termination section 312 of the latch mechanism 30. Accordingly a block 452 is formed between the two hollows 451. A top and bottom of the clasping portion 45 respectively extend rearward to form a pair of protrusions. An appropriate place of each protrusion defines a fixing hole 453 in accordance with the fixing lump 17 of the housing 10.

Referring to FIG. 1, FIG. 3 and FIG. 7, in assembly, the electric terminal 20 is received in the terminal chamber 15 of the housing 10. The fixing portion 21 and the bent portion 23 are configured in the terminal cavity 151. The soldering portion 22 protrudes out from the front surface 11 of the housing 10. The contact portion 25 passes through the terminal slot 152 and protrudes out from the back surface 12 of the housing 10. The preventing portion 24 abuts against the preventing wall 153.

Referring to FIG. 1 and FIG. 7, when the latch mechanism 30 is configured in the perforation 16 of the housing 10, the two beams 31 are received in the perforation 16 and compressed by inner surfaces of the sidewall 18, the first projection 313 buckles into the second recess 315 and the second projections 316 buckles into the first recesses 314, then the two beams 31 abuts against each other. The preventing section 311 is received in the corresponding groove 19 and abuts against the preventing surface 20. The termination section 312 protrudes out from the front of the perforation 16 and abuts against the front surface of the sidewall 18. The cover 40 is configured adjacent to the front surface 11 of the housing 10. The top wall 43 and the bottom wall 44 respectively abut against the top surface 13 and the bottom surface 14 of the housing 10. The fixing lump 17 of the housing 10 buckles into the corresponding fixing hole 453 of the cover 40. The soldering portion 22 of the electric terminal 20 passes through the aperture 42 of the cover 40 to connect with the conductive cable (not shown). The termination section 312 of the latch mechanism 30 is received in the hollow 451 of the cover 40 and the block 452 lies between the two termination sections 312.

As described above, when the latch mechanism 30 is configured in the housing 10, the preventing section 311 and the termination section 312 can firmly abut against the preventing surface 20 and the front surface of the sidewall 18. At the same time, the block 452 of the cover 40 can prevent the two termination sections 312 of the latch mechanism 30 from jointing together because of being softened in the process of high-temperature shaping to ensure that the latch mechanism 30 is held in the housing 10 firmly.

What is claimed is:

1. A plug connector, comprising:

a housing, the middle of the housing defining a plurality of terminal chambers, two sides of the housing forming two sidewalls and each sidewall defining a perforation passing through a front surface and a rear surface thereof, a top and bottom of the rear of the perforation respectively concaving outward to form a pair of grooves, a preventing surface formed at the junction of the perforation and the groove;

a plurality of electric terminals, received in the terminal chambers of the housing;

at least one latch mechanism, having a pair of beams extending longitudinally and spacing from each other, a rear end of the beam protruding outward to form a preventing section and a front end of the beam protruding outward to form a termination section, an inside of one of the beams defining a first projection and two first recesses adjacent to two sides of the first projection, accordingly an inside of the other beam defining a second recess and two second projections adjacent to two sides of the second recess, the rear ends of the two beams respectively extending rearward and then bending inward to connect with each other to form a latch tab, the preventing section received in the corresponding groove and against the preventing surface, the termination section abutting against the front surface of the sidewall, the projections and the corresponding recesses buckling with each other; and a cover, covering a front surface of the housing, having a base, both ends of the base respectively extending sideward to form a clasping portion, an upper and lower place of a rear surface of each clasping portion respectively concaving inward to form a hollow to receive the corresponding termination section of the latch mechanism, a block formed between the two hollows and lying between the two termination sections of the latch mechanism.

2. The plug connector as claimed in claim 1, wherein the top and bottom of the latch tab respectively concaves inward to form a fillister.

3. The plug connector as claimed in claim 1, wherein the front of top and bottom surfaces of the sidewall respectively defines a fixing lump, the top and bottom of the clasping portion of the cover respectively extends rearward to form a pair of protrusions, an appropriate place of each protrusion defines a fixing hole, the fixing lump buckles into the corresponding fixing hole.

* * * * *